United States Patent [19]

Tanaka et al.

[11] 4,150,984

[45] Apr. 24, 1979

[54] TUNGSTEN CARBIDE-BASE SINTERED ALLOYS AND METHOD FOR PRODUCTION THEREOF

[75] Inventors: Hiroshi Tanaka; Yoshihiro Yamamoto, both of Nagoya, Japan

[73] Assignee: NGK Spark Plug Co., Ltd., Nagoya, Japan

[21] Appl. No.: 833,611

[22] Filed: Sep. 15, 1977

[51] Int. Cl.[2] ..... B22F 3/00; C22C 29/00

[52] U.S. Cl. ..... 75/238; 75/242

[58] Field of Search ..... 75/238, 242

[56] References Cited

U.S. PATENT DOCUMENTS

| | | | |
|---|---|---|---|
| 3,741,733 | 6/1973 | Kieffer | 75/238 |
| 3,752,655 | 8/1973 | Ramquist | 75/238 |
| 4,065,301 | 12/1977 | Tanaka et al. | 75/203 |

*Primary Examiner*—Brooks H. Hunt

*Attorney, Agent, or Firm*—Sughrue, Rothwell, Mion, Zinn and Macpeak

[57] ABSTRACT

A tungsten carbide-base sintered alloy is disclosed, which has a compact three-phase structure consisted of a grain phase of a metal carbide composed mainly of tungsten carbide, a grain covering layer phase of a complex carbo-nitride of titanium and a metal element composed mainly of tungsten in the metal carbide, and a bonding phase composed mainly of nickel and which exhibits very high hardness and high-wear-resistance properties.

8 Claims, 2 Drawing Figures

※ THE PRESENT ALLOY IS IN AN AREA SUROUNDED BY SOLID THICK LINES

※ NUMERALS AT POINTS REPRESENT THE TRANSVERSE RUPTURE (mkg/mm²)

TUNGSTEN CARBIDE-BASE SINTERED ALLOYS AND METHOD FOR PRODUCTION THEREOF

BACKGROUND OF THE INVENTION

This invention relates to WC (tungsten carbide)-base sintered alloys and a method for their production.

WC-base sintered alloys are used as various industrial materials, for example, cutting tools, metal forming tools (such as wire drawing dies or blanking dies), mining tools and wear-resistant tools because of their high mechanical strength and hardness and superior wear resistance. WC-base sintered alloys for cutting tools are used in a very wide range since it has higher toughness than other materials such as TiC(titanium carbide)-base sintered alloys, TiN (titanium nitride)-base sintered alloys and alumina-base sintered ceramics, and undergo little damage during a machining operation. However, the WC-base sintered alloys have inferior chemical stability as demonstrated by the fact that they are more susceptible to reaction with a workpiece and to oxidation than the other sintered alloys. Thus, they have the defect that when used as cutting tools, they tend to undergo crater wear and flank wear during high-speed machining. With the higher speeds of machining employed in recent years, the range of the use of the WC-base sintered alloys has gradually been narrowed.

Various methods have been used to remove the defects of the WC-base sintered alloys, but the addition of TiC is the most widely practised method.

A WC-TiC-Co sintered alloy has improved chemical stability, but suffers from markedly reduced mechanical strength and thermal conductivity. This is probably because while a WC-Co sintered alloy is composed of a WC phase and a bonding metal phase the WC-TiC-Co sintered alloy contains as a third phase a covering layer of a complex carbide of titanium and tungsten [(WTi)C] surrounding the WC layer, and this covering layer is brittle and during sintering, tends to be subject to grain growth. Thus, addition of much TiC in an attempt to improve resistances to crater wear and wear at the time of high-speed machining results in a marked reduction in strength, and tends to cause damage.

Accordingly, the tool manufacturers provide alloys with varying amounts of TiC. It has also been attempted to make WC-base sintered alloys containing TaC (tantalum carbide), NbC (niobium carbide), VC (vanadium carbide) and $Mo_2C$ (molybdenum carbide). But all of these alloys have the defect that the strength of the WC-Co alloy is reduced.

SUMMARY OF THE INVENTION

It is an object of this invention to provide a WC-base sintered alloys for tools which has chemical stability and high strength, and has the advantage of undergoing little crater wear and having superior machining characteristics at high speed.

The above object can be achieved by a compact three-phase structure consisting of a grain layer of a metal carbide composed mainly of WC, a grain covering layer phase of a complex carbo-nitride of Ti and a metal element composed mainly of W in the metal carbide, and a bonding phase composed mainly of Ni.

DETAILED DESCRIPTION OF THE INVENTION

Figure 1:
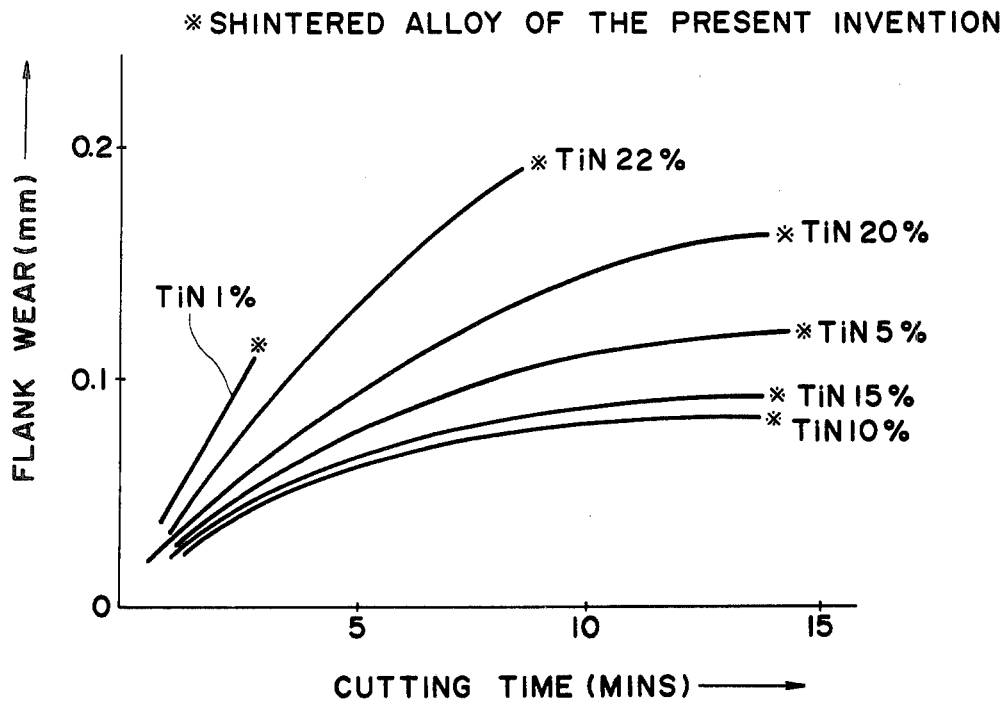
FIG. 1 is a graph showing cutting perpormances of cutting tools made of alloys containing WC-base sintered alloys of the present invention and TiN different in amount.

The WC-base sintered alloy having the aforesaid improved structure is a compact WC-base sintered alloy which assumes a three-phase structure consisting of very fine carbide grains having a size of about 1 micron, a covering layer surrounding these grains and a bonding phase and does not substantially contain graphite and detrimental pores. The covering layer consists of a complex carbo-nitride of titanium and a metal element (mainly W) in the metal carbide that forms the grain phase. If, for example, the grain phase consists only of WC and does not contain another metal carbide which can be present as a partial replacement of WC as an additive, the covering layer becomes a (Ti W)CN layer. It has been found that since the covering layer of a complex carbo-nitride of Ti and a metal composed mainly of W, which is formed around the grain phase inhibits grain growth and has high strength, it can increase the chemical stability of the sintered alloy while retaining its strength.

Generally, Co is used as a bonding metal for conventional WC-base sintered alloys. In special cases, Fe and Ni-Co alloy are used, but Ni is scarcely used alone. In contrast, only Ni having good wettability and high solubility in Ti is used as a bonding metal in the invention to precipitate the complex carbide nitride composed mainly of Ti and W effectively. The use of Co or Fe alone or together with Ni tends to cause the formation of cavities and cannot give a compact sintered alloy. In a manufacturing process for producing such sintered alloys, it is the usual practice to perform ball milling for long periods of time using balls made of WC-Co alloy. At this time, 2 to 3% of Co gets mixed with the alloy, but the inclusion of Co in such amount does not deteriorate the alloy.

The WC-base sintered alloy of improved structure can be manufactured by adding a carbon powder to mixture of 5 to 25% by weight of an Ni powder, 2 to 20% by weight of a TiN powder and the remainder being a metal carbide powder cpmposed mainly of a WC powder, the amount of the carbon powder being 2 to 12% by weight based on the TiN powder; and then subjecting the mixture to a usual powder-metallurgical method including molding and sintering.

In the manufacturing method in accordance with the present invention, the amount of Ni is limited to 5 to 25% by weight for the same reason as in ordinary sintered alloys. If it is too small, the strength of the alloy is decreased, and if it is too large, the hardness of the alloy decreases.

In the method for producing the sintered alloy of this invention, the TiN powder is advantageously a commercially available powder having an N content of at least 20% by weight and a particle diameter of not more than 2.5 microns. The amount of TiN incorporated seems to have a correlation with the amount of WC because it will form a covering layer for covering the WC grains in the alloy and bring about an improvement in the properties of the WC-base sintered alloy such as oxidation resistance by reducing the grains to a fine size. As a result of experiment, it has been found that its suitable amount has no relation with ingredients other than carbon. Specifically, if the amount of TiN is less than 2%, it scarcely serves to form an effective covering layer and the oxidation resistance and resistance to reaction with other metals of the sintered alloy are poor. If the amount of TiN exceeds 20%, compactness cannot be obtained and the characteristic strength of the WC-base sintered alloy is reduced.

Table 1 summarizes the amount of TiN versus oxidation resistance and transverse rupture strength which were determined on sintered alloys prepared from 90% by weight of (WC+TiN), 10% by weight of Ni, and C in a C/TiN weight ratio of 5/100. Sintered alloys with a TiN content of 1% of less have poor oxidation resistance, and no effect of covering the WC grains by (TiW)CN is obtained. A sintered alloy having 22% of TiN has many pores and its transverse rupture strength is reduced.

Table 1

| Amount of TiN (%) | Oxidation resistance (increased amount by oxidiation after maintaining in air at 700° C. for 2 hours; %) | Transverse rupture strength ($kg/mm^2$) |
|---|---|---|
| 0 | 1.88 | 158 |
| 1 | 1.04 | 150 |
| *2 | 0.27 | 145 |
| *5 | 0.19 | 142 |
| *10 | 0.12 | 140 |
| *20 | 0.09 | 129 |
| 22 | 0.09 | 85 |

*Sintered alloys in accordance with the invention.

FIG. 1 is a wear curve determined with regard to cutting tools made of sintered alloys having a TiN content of 1%, 5%, 10%, 15%, 20%, and 22%, respectively.

Specifically, SNP 432 tipes were made from each of these sintered alloys, and using a milling machine having a three-blade cutting fitted with each of the above tips, chromium-molybdenum steel (HRC 33) blocks (100×10 mm) were machined at a peripheral speed of 170 m/min. with a depth of cut of 2.0 mm and a feed of 0.26 mm per blade. The relation between the wear width of the flank and the machining time was determined, and shown in FIG. 1. It is seen that TiN contents of 10 to 15% are most advantageous.

The C powder may be carbon black or graphite powder, but should be in the form of a fine powder. The amount of carbon depends only upon the amount of TiN in order to obtain a compact sintered body, and no dependence upon the other ingredients is recognized.

Figure 2:
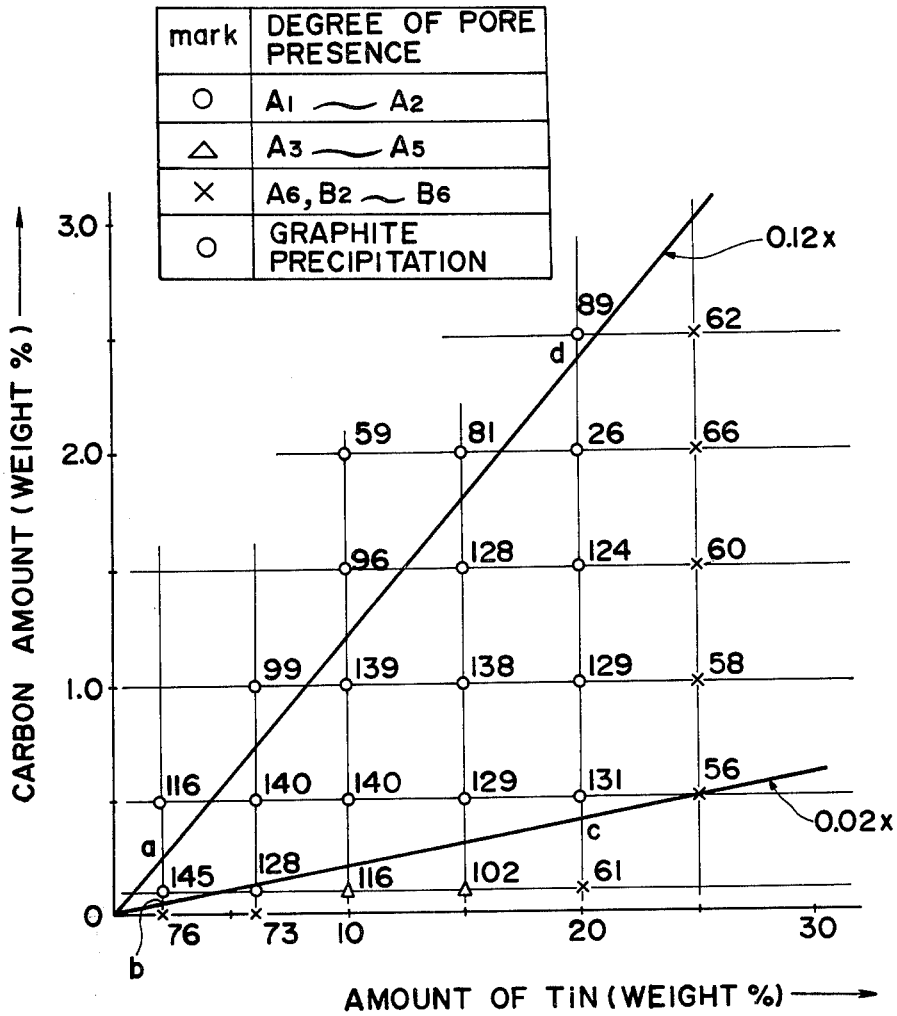
FIG. 2 is a graph showing the degree of the presence of pores plotted according to the porosity chart of ASTM and the transverse rupture strength of the alloys containing the WC-base sintered alloy of the present invention, TiN and C, the latter two in the alloy being different in amount respectively.

FIG. 2 shows the dependence of the amount of C upon the amount of TiN when the amount of (WC+TiN) was 90% by weight and the amount of Ni was 10% by weight. In FIG. 2, the degrees of the presence of pores in cross section of sintered alloys at various positions are shown by the types of markings indicating the positions. The numerals attached to the markings show transverse rupture strength values ($kg/mm^2$). The degrees of the presence of pores are indicated by the porosity chart of ASTM where O represents grades A1–A2, Δ grades A3–A5, × grades A6 or B2 to B2 to B6, and • shows the precipitation of graphite. In these indications, letter A shows pores having a size of less than 10 microns, and letter B shows pores having a size of 10 to 40 microns. The numerals following these letters show the density of the presence of the pores, and the larger numerals show the presence of a greater number of pores. It can be seen from FIG. 2 that C should be added in an amount of 0.02× to 0.12× based on the amount (×) of TiN. If the amount of C is less than 0.02×, the number of pores is large, and if it is larger than 0.12×, graphite precipitates. In both cases, a compact three-phase structure is not obtained, and the transverse rupture strength of the alloy is reduced so that it does not have characteristics suitable for toolmaking materials.

Generally, a carbonaceous material used for WC-base sintered alloy contains 0.1% or less of free carbon. Since the free carbon brings about the same effect as does carbon added in accordance with this invention, the amount of carbon should of course be the total amount of both. In the production of ordinary WC-base sintered alloys, it is common practice to mix an organic binder in order to improve their press-formability. If the amount of the organic binder is excessive, or depending upon the atmosphere in which a binder-removing operation is carried out, the organic binder may change to carbon and remain in the final alloy. Such carbon should also be considered as included in the amount of carbon added in accordance with present invention.

The WC powder is a powder usually employed for WC-Co type sintered alloys.

In the production of ordinary WC-base sintered alloys, it is the practice to replace a part of WC by a carbide such as TiC or $Mo_2C$ in an attempt to improve various characteristics. This replacement by carbide is also possible in the present invention. However, the effect of improving properties by the covering layer is great in the WC-base sintered alloy of the present invention, and the degree of the effect of adding TiC, $Mo_2C$, etc. is smaller than in other WC-base sintered alloys outside the scope of the invention.

Since the addition of large quantities of these carbides causes a reduction in strength, their amounts of replacement are restricted. Experiment shows that when either one or both of TiC and $Mo_2C$ are used to replace not more than 15% by weight of WC which constitutes the grain phase the properties of the resulting alloy are equivalent to, or better than, those of WC-base sintered alloys obtained whithout such replacement.

In the method of this invention, the covering layer of a complex carbo-nitride of Ti and the metal in a metal carbide which constitutes the grain layer is considered to be formed by the following mechanism. At the time of sintering, the carbon powder first dissolves in the bonding metal Ni, and then, the TiN powder dissolves in it. The dissolved Ti, C and N reacts with one another and precipitate as TiCN on the grains. TiCN reacts with the metal carbide consisting mainly of WC which constitutes the grains, thereby to form a covering layer of a complex carbo-nitride of Ti and the metal composed mainly of W in the metal carbide. Or the metal carbide consisting mainly of WC forming the grains dissolved partly in the bonding metal (Ni) reacts with TiCN, and the reaction product precipitates on the grains, thereby to directly form a covering layer of a complex carbo-nitride of Ti and the metal consisting mainly of W in the metal carbide.

The following Examples illustrate the present invention.

EXAMPLE 1

A WC powder having a total carbon content of 6.15% by weight, a free carbon content of 0.03% by weight and an average particle diameter of 2.1 microns, 20.9% by weight of Ni, a TiN powder having an average particle diameter of 1.7 microns, a carbonyl nickel powder having an average particle diameter of 2.7 microns, carbon black, an $Mo_2C$ powder having an average particle diameter of 2.3 microns, and a TiC powder having an average particle diameter of 1.3 microns were blended by the formulations indicated in Table 2. Acetone was added, and they were milled in the wet state for 100 hours in a stainless steel pot having balls of WC-Co sintered alloy accomodated therein. After drying, 1.0% by weight of paraffin was added to the mixed powder, and the mixture was press-formed at a pressure of 2 t/cm$^2$. The molded product was maintained at 400° C. under vacuum to remove the paraffin, and then sintered at 1400° to 1500° C. under a vacuum of $10^{-2}$ mmHg for 1 hour. The properties of the sintered alloy obtained are shown in Table 2.

Table 2

| | | Blending formulations (wt. %) | | | | | | Properties after sintering | |
|---|---|---|---|---|---|---|---|---|---|
| | | WC | TiN | $Mo_2C$ | TiC | Ni | C | Hardness (HRA) | Transverse rupture strength (kg/mm$^2$) |
| Alloys of the invention | A | 80 | 10 | — | — | 10 | 0.8 | 91.7 | 131 |
| | B | 65 | 15 | 10 | — | 10 | 1.2 | 92.2 | 142 |
| | C | 65 | 15 | 5 | 5 | 10 | 0.5 | 92.2 | 139 |
| Alloy for comparison | D | 80 | 10 | — | — | Ni5 Co5 | 0.8 | 90.2 | 75 |

The four sintered alloys A to D shown above, two commercially available WC-Ti C-TaC-Co sintered alloys E and F corresponding to P10 and P20 (for use in machining steel) by ISO classifications, and a commercially available WC-Co sintered alloy G corresponding to K10 (for use in machining cast iron) by ISO classifications were each formed into tools having a shape shown by SNP 432. These tools were put to machining tests under the following conditions. The results are shown in Table 3.

Test I

Chromium-molybdenum alloy steel rod (HRC 33; 120 mm $\phi \times 80$ mmL) were worked on a lathe at a surface speed of 170 m/min. with a depth of cut of 1.0 mm and a feed of 0.31 mm/rev. This machining operation was repeated 8 times.

Test II

An SCM4Ⓗ block (100×100 mm) was mounted on a milling machine and machined at a surface speed of 180 mm/min. with a depth of cut of 2.0 mm and a feed of 0.26 mm per blade.

Test III

An FC 20 cast iron block (100×200 mm) was mounted on a milling machine, and machined at a surface speed of 80 m/min. with a depth of cut of 3.0 mm and a feed of 0.27 mm per blade. This machining operation was repeated 30 times.

Table 3

| | | Test I Wear width (mm) of the flank after machining | Test II Number of Cycles machining until the occurrence of damage | Test III Depth of crater wear after machining (microns) |
|---|---|---|---|---|
| Alloys of the invention | A | 0.28 | 29 | 45 |
| | B | 0.22 | 35 | 48 |
| | C | 0.25 | 32 | 47 |
| Alloy of comparison | D | damaged (in the 5th operation) | 5 | damaged (in the 8th operation) |
| Commercially available alloys | F (corresponding to P10) | 0.35 | 5 | damaged (in the 12th operation) |
| Commercially available alloys | F (corresponding to P20) | 0.47 | 2.5 | 110 |
| | G (corresponding to K10) | — | 11 | 208 |

It can be seen from Example 1 that the WC-base sintered alloys A,B and C in accordance with the present invention are fully suitable for three uses P10, P20 and K10 by JIS classifications.

It was found that the WC-base sintered alloys can also be produced by using a TiCN(titanium carbonitride) powder instead of the TiN powder used in the procedure described above.

Thus, the WC-base sintered alloy of this invention can be produced by adding a small amount of a carbon powder to a mixture consisting of 5 to 25% by weight of an Ni powder, a TiCN powder capable of containing 2 to 20% by weight of a TiN powder and the remainder being a metal carbide powder consisting mainly of a WC powder, and then processing the resulting mixture by conventional powder-metallurgical means including molding and sintering. Experiment showed that the weight ratio of N/(N+C) in TiCN is preferably at least 0.5.

EXAMPLE 2

A TiC powder and a TiN powder were mixed at a TiC/TiN weight ratio of 2/8, 5/5, and 8/2, respectively, and reacted at 1500° C. under vacuum for 1 hour. The reacted mixture was pulverized to an average particle diameter of about 1.5 microns. In this manner, three kinds of a TiCN powder were prepared.

Using the TiCN powders, sintered alloys H, I, J and K having the formulations shown in Table 4 were produced in the same way as in Example 1. The properties of the sintered alloys obtained are shown in Table 4.

Table 4

| | | Blending formulation (wt. %) | | | | | | | Properties after sintering | |
|---|---|---|---|---|---|---|---|---|---|---|
| | | WC | TiN (2:8) | TiCN (5:5) | TiCN (8:2) | TiCN (8:2) | Ni | C | Hardness (HRA) | transverse rupture strength (kg/mm$^2$) |
| Alloys of the invention | H | 80 | — | 10 | — | — | 10 | 0.62 | 91.8 | 139 |
| | I | 80 | — | — | 10 | — | 10 | 0.40 | 91.7 | 133 |
| | J | 80 | 5 | — | 5 | — | 10 | 0.75 | 91.7 | 12.9 |
| Alloy of comparison | K | 80 | — | — | — | 10 | 10 | 0.25 | 91.8 | 10.8 |

Tools having a shape shown by SNP 432 were made from the three sintered alloys H, I and J, and subjected to the same machining tests as in Example 1. The results are shown in Table 5.

Table 5

| | | Test I Wear width (mm) of the flank after machining | Test II Number of cycles of machining until the occurrence of damage | Test III Depth of crater wear after machining (microns) |
|---|---|---|---|---|
| Alloys of the invention | H | 0.28 | 27 | 49 |
| | I | 0.30 | 28 | 51 |
| | J | 0.29 | 27 | 49 |
| Alloy of comparison | K | 0.39 | 4 | Damaged |

What we claim is:

1. A tungsten carbide-base sintered alloy of a compact three-phase structure which consists of a grain phase of very fine grains of a metal carbide composed mainly of tungsten carbide, a grain covering phase of a complex carbo-nitride of titanium and the metal element of the metal carbide, surrounding the fine grains, and a bonding phase composed mainly of nickel.

2. A method for producing a tungsten carbide-base sintered alloy of a compact three-phase structure which consists of a grain phase of very fine grains of a metal carbide composed mainly of tungsten carbide, a grain covering phase of a complex carbo-nitride of titanium and the metal element of the metal carbide, surrounding the fine grains, and a bonding phase composed mainly of nickel; said method comprising adding a carbon powder to a mixture consisting of 5 to 25% by weight of a nickel powder, 2 to 20% by weight of a titanium nitride powder, and the remainder being a metal carbide powder composed mainly of a tungsten carbide powder, the amount of the carbon powder being 2 to 12% by weight based on the weight of the titanium nitride powder, and molding and sintering the mixture, whereby said sintered alloy is produced.

3. The method of claim 2 wherein the metal carbide powder consists only of tungsten carbide powder.

4. The method of claim 2 wherein the metal carbide powder consists of a tungsten carbide powder and up to 15% by weight of titanium nitride and/or molybdenum carbide powder.

5. The method of claim 3 wherein the amount of the titanium nitride is 10 to 15% by weight.

6. A method for producing a tungsten carbide-base sintered alloy of a compact three-phase structure which consists of a grain phase of a metal carbide composed mainly of tungsten carbide, a grain covering phase of a complex carbo-nitride of titanium and a metal element composed mainly of tungsten in the metal carbide, and a bonding phase composed mainly of nickel; said method comprising adding a small amount of a carbon powder to a mixture consisting of 5 to 25% by weight of a nickel powder, a titanium carbide nitride powder which may contain 2 to 20% by weight of a titanium nitride powder, and the remainder being a metal carbide powder composed mainly of a tungsten carbide powder, and molding and sintering the mixture.

7. The method of claim 6 wherein the weight ratio of N/(N+C) in the titanium carbide nitride is at least 0.5.

8. The method of claim 4 wherein the amount of the titanium nitride is 10 to 15% by weight.

* * * * *